US007760108B2

(12) United States Patent
McCall et al.

(10) Patent No.: US 7,760,108 B2
(45) Date of Patent: Jul. 20, 2010

(54) METHODS AND SYSTEMS FOR REMOTELY STARTING ENGINES OF VEHICLES

(75) Inventors: Clark E. McCall, Ann Arbor, MI (US); William A. Biondo, Beverly Hills, MI (US); David T. Proefke, Madison Heights, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 110 days.

(21) Appl. No.: 12/266,118

(22) Filed: Nov. 6, 2008

(65) Prior Publication Data

US 2010/0108008 A1 May 6, 2010

(51) Int. Cl.
*G08C 19/00* (2006.01)

(52) U.S. Cl. ..... 340/825.62; 340/825.69

(58) Field of Classification Search ..... 123/179.2; 701/102; 340/825.62, 825.69, 5.72, 426.13
See application file for complete search history.

(56) References Cited

U.S. PATENT DOCUMENTS 5,673,017 A * 9/1997 Dery et al. ..... 340/426.17
5,942,988 A * 8/1999 Snyder et al. ..... 340/825.69
6,037,675 A * 3/2000 Yoshida et al. ..... 307/10.2
6,127,740 A * 10/2000 Roddy et al. ..... 307/10.1
RE38,338 E * 12/2003 Yoshida et al. ..... 307/10.2
7,289,774 B2 * 10/2007 Jorgensen ..... 455/103
7,474,195 B2 * 1/2009 Farrell ..... 340/5.72
7,551,057 B2 * 6/2009 King et al. ..... 340/5.72
2002/0111756 A1 * 8/2002 Modgil ..... 702/63
2002/0190843 A1 * 12/2002 Konno et al. ..... 340/5.64
2003/0150416 A1 * 8/2003 Flick ..... 123/179.2
2004/0226529 A1 * 11/2004 Nantz et al. ..... 123/179.2
2005/0232376 A1 * 10/2005 Liem et al. ..... 375/322
2006/0087405 A1 * 4/2006 Koike et al. ..... 340/5.64
2006/0109125 A1 * 5/2006 Overhultz et al. ..... 340/572.1
2007/0018793 A1 * 1/2007 Stewart et al. ..... 340/10.3
2008/0079603 A1 * 4/2008 King et al. ..... 340/825.69
2008/0114501 A1 * 5/2008 Wu ..... 701/2

* cited by examiner

*Primary Examiner*—Stephen K Cronin
*Assistant Examiner*—Sizo B Vilakazi
(74) *Attorney, Agent, or Firm*—Ingrassia Fisher & Lorenz, P.C.

(57) ABSTRACT

A method for remotely starting an engine of a vehicle includes the steps of transmitting a first plurality of engine start signals to the vehicle and transmitting a second plurality of engine start signals to the vehicle. Each of the first plurality of engine start signals having a first power level. Each of the second plurality of engine start signals having a second power level that is less than the first power level.

20 Claims, 3 Drawing Sheets

METHODS AND SYSTEMS FOR REMOTELY STARTING ENGINES OF VEHICLES

TECHNICAL FIELD

The present invention generally relates to the field of vehicles and, more specifically, to methods and systems for remotely starting engines of vehicles.

BACKGROUND OF THE INVENTION

Certain vehicles today include remote start systems and algorithms that enable a user of the vehicle to remotely start an engine of the vehicle. Such a remote start of the engine may be desired, for example, if the user wishes to have the vehicle's interior heated or cooled before the user enters the vehicle. However, in certain situations it may be difficult to remotely start the engine of the vehicle if a battery of the vehicle has a low state of charge.

Accordingly, it is desirable to provide an improved method for remotely starting an engine of the vehicle. It is also desirable to provide an improved program product for such remote starting of an engine of a vehicle. It is further desired to provide an improved system for such remote starting of an engine of a vehicle. Furthermore, other desirable features and characteristics of the present invention will be apparent from the subsequent detailed description and the appended claims, taken in conjunction with the accompanying drawings and the foregoing technical field and background.

SUMMARY OF THE INVENTION

In accordance with an exemplary embodiment of the present invention, a method for remotely starting an engine of a vehicle is provided. The method comprises the steps of transmitting a first plurality of engine start signals to the vehicle and transmitting a second plurality of engine start signals to the vehicle. Each of the first plurality of engine start signals has a first power level. Each of the second plurality of engine start signals has a second power level that is less than the first power level.

In accordance with another exemplary embodiment of the present invention, a program product for remotely starting an engine of a vehicle is provided. The program product comprises a program and a computer-readable signal-bearing media. The program is configured to at least facilitate transmitting a first plurality of engine start signals to the vehicle and transmitting a second plurality of engine start signals to the vehicle. Each of the first plurality of engine start signals has a first power level. Each of the second plurality of engine start signals has a second power level that is less than the first power level. The computer-readable signal-bearing media bears the program.

In accordance with a further exemplary embodiment of the present invention, a system for remotely starting an engine of a vehicle is provided. The system comprises a processor and a transmitter. The processor is configured to at least facilitate determining whether a remote start request has been received. The transmitter is coupled to the processor, and is configured to at least facilitate transmitting a first plurality of engine start signals to the vehicle and transmitting a second plurality of engine start signals to the vehicle. Each of the first plurality of engine start signals has a first power level. Each of the second plurality of engine start signals has a second power level that is less than the first power level.

BRIEF DESCRIPTION OF THE DRAWINGS

The present invention will hereinafter be described in conjunction with the following drawing figures, wherein like numerals denote like elements, and wherein.

DETAILED DESCRIPTION OF THE INVENTION

The following detailed description is merely exemplary in nature, and is not intended to limit the invention or the application and uses of the invention. Furthermore, there is no intention to be bound by any expressed or implied theory presented in the preceding technical field, background, brief summary or the following detailed description.

Figure 1:
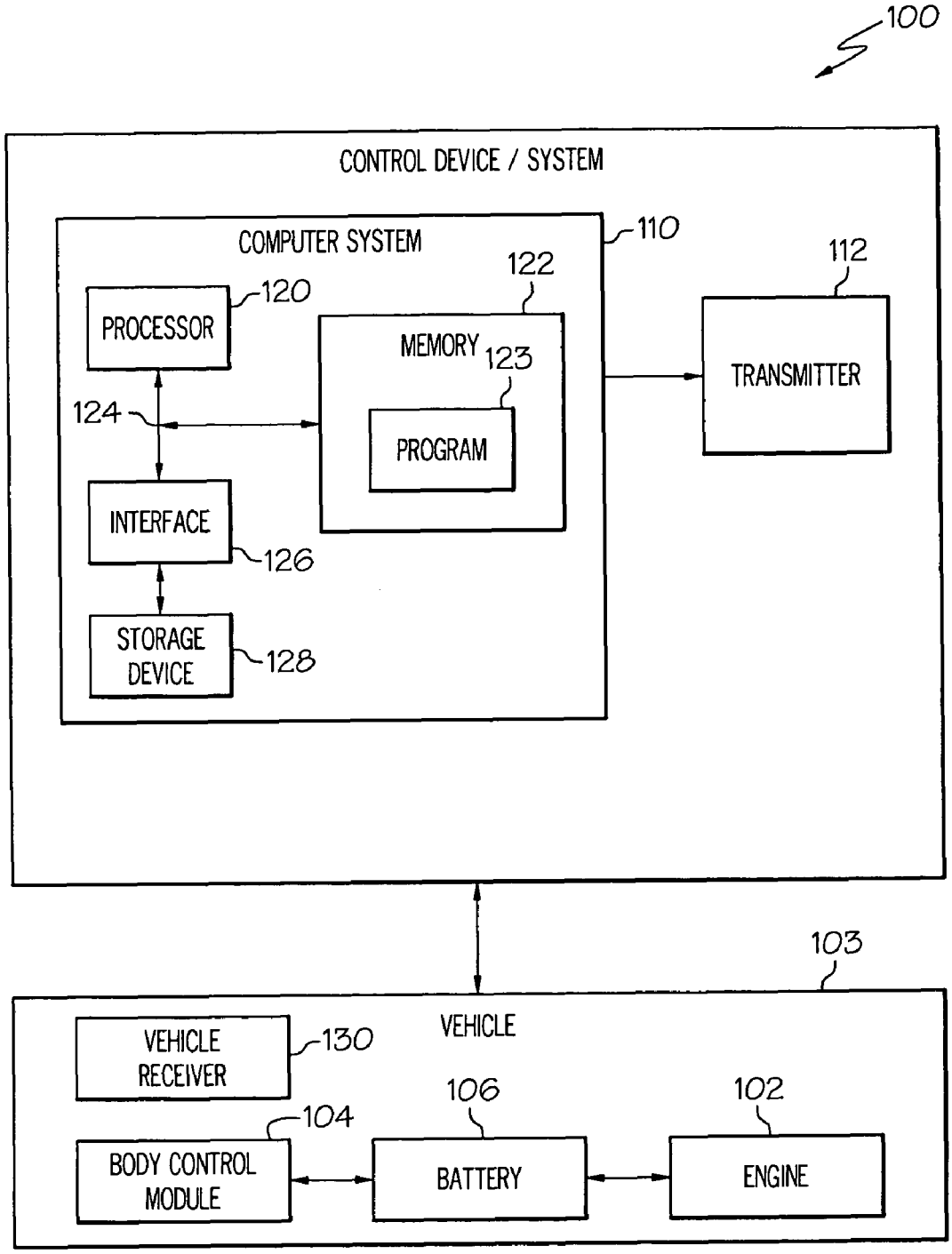
FIG. 1 is a functional block diagram of a control system for remotely starting an engine of a vehicle, in accordance with an exemplary embodiment of the present invention.

FIG. 1 is a functional block diagram of a control system 100 for remotely starting an engine 102 of a vehicle 103, in accordance with an exemplary embodiment of the present invention. As shown in FIG. 1, the vehicle 103 preferably also includes a body control module 104 that at least facilitates starting the engine 102 via energy from a battery 106. Also as shown in FIG. 1, the vehicle 103 preferably also includes a vehicle receiver 130 to receive remote start signals from the control system 100. In certain preferred embodiments, the vehicle 103 comprises an automobile such as a sedan, a truck, a van, a sport utility vehicle, or another type of automobile. However, in various embodiments, the control system 100 can be used in connection with any number of types of vehicles and/or systems thereof.

As depicted in FIG. 1, the control system 100 comprises a computer system 110 and a transmitter 112. Specifically, in one preferred embodiment, the control system 100 comprises a key fob unit or similar device that includes the computer system 110 and the transmitter 112 of FIG. 1.

The computer system 110 is configured to at least facilitate receiving a remote start request and providing, in response thereto, instructions to the transmitter 112 for sending engine start signals to remotely start the engine 102 of the vehicle 103. In the embodiment depicted in FIG. 1, the computer system 110 includes a processor 120, a memory 122, a computer bus 124, an interface 126, and a storage device 128.

The processor 120 determines whether a remote start request has been received from a user of the vehicle 103, provides instructions to the transmitter 112 for sending engine start signals to remotely start the engine 102 of the vehicle 103, and performs the computation and control functions of the computer system 110 or portions thereof. The processor 120 may comprise any type of processor or multiple processors, single integrated circuits such as a microprocessor, or any suitable number of integrated circuit devices and/or circuit boards working in cooperation to accomplish the functions of a processing unit. During operation, the processor 120 executes one or more programs 123 preferably stored within the memory 122 and, as such, controls the general operation of the computer system 110.

As referenced above, the memory 122 stores a program or programs 123 that execute one or more embodiments of a process 200 described below in connection with FIG. 2 and/or various steps thereof and/or other processes, such as those described elsewhere herein. The memory 122 can be any type of suitable memory. This would include various types of dynamic random access memory (DRAM) such as SDRAM, various types of static RAM (SRAM), and various types of non-volatile memory (PROM, EPROM, and flash). It should be understood that the memory 122 may be a single type of memory component, or it may be composed of many different types of memory components. In addition, the memory 122 and the processor 120 may be distributed across several different computers that collectively comprise the computer system 110. For example, a portion of the memory 122 may reside on a computer within a particular apparatus or process, and another portion may reside on a remote computer.

The computer bus 124 serves to transmit programs, data, status and other information or signals between the various components of the computer system 110. The computer bus 124 can be any suitable physical or logical means of connecting computer systems and components. This includes, but is not limited to, direct hard-wired connections, fiber optics, infrared and wireless bus technologies.

The interface 126 allows communication to the computer system 110, for example from a vehicle user, a system operator, and/or another computer system, and can be implemented using any suitable method and apparatus. In a preferred embodiment, the interface 126 receives a remote start request from a user of the vehicle 103 desiring to remotely start the vehicle 103, and the interface 126 provides a signal representative thereof to the processor 120 for processing in accordance with the steps of the process 200 described further below in connection with FIG. 2.

The storage device 128 can be any suitable type of storage apparatus, including direct access storage devices such as hard disk drives, flash systems, floppy disk drives and optical disk drives. In one exemplary embodiment, the storage device 128 is a program product from which memory 122 can receive a program 123 that executes one or more embodiments of the process 200 of FIG. 2 and/or steps thereof as described in greater detail further below. In one preferred embodiment, such a program product can be implemented as part of, inserted into, or otherwise coupled to the control system 100. As one exemplary implementation, the computer system 110 may also utilize an Internet website, for example for providing or maintaining data or performing operations thereon.

It will be appreciated that while this exemplary embodiment is described in the context of a fully functioning computer system, those skilled in the art will recognize that the embodiments of the present invention are capable of being distributed as a program product in a variety of forms, and that the present invention applies equally regardless of the particular type of computer-readable signal bearing media used to carry out the distribution. Examples of signal bearing media include: recordable media such as floppy disks, hard drives, memory cards and optical disks, and transmission media such as digital and analog communication links. It will similarly be appreciated that the computer system 110 may also otherwise differ from the embodiment depicted in FIG. 1, for example in that the computer system 110 may be coupled to or may otherwise utilize one or more remote computer systems and/or other control systems.

The transmitter 112 is coupled to the computer system 110, and specifically to the processor 120 thereof. The transmitter 112 is configured to receive instructions from the processor 120 and to transmit various engine start signals to the vehicle 103 based thereon. Specifically, the transmitter 112 is configured to transmit a first group of engine start signals and a second group of engine start signals to the vehicle 103 after receiving one or more signals indicating that a remote start request has been received by the computer system 110 from a user of the vehicle 103. Each of the first group of engine start signals has a first power level, and each of the second group of engine start signals has a second power level that is less than the first power level.

In a preferred embodiment, the transmitter 112 transmits the first group of engine start signals that are a first period apart (for example, that are approximately X milliseconds apart). After completion of the transmission of the first group of engine start signals, the transmitter 112 transmits the second group of engine start signals approximately Y milliseconds apart, with Y being less than X. For example, in one preferred embodiment, the transmitter 112 transmits the engine start signals of the first group of engine start signals approximately one hundred milliseconds apart, and transmits the engine start signals of the second group of engine start signals approximately thirty milliseconds apart. Also in a preferred embodiment, the transmitter 112 transmits a smaller number of first engine start signals (e.g., less than five engine start signals in one exemplary embodiment) than second engine start signals (e.g., more than thirty second engine start signals in one exemplary embodiment).

Figure 2:
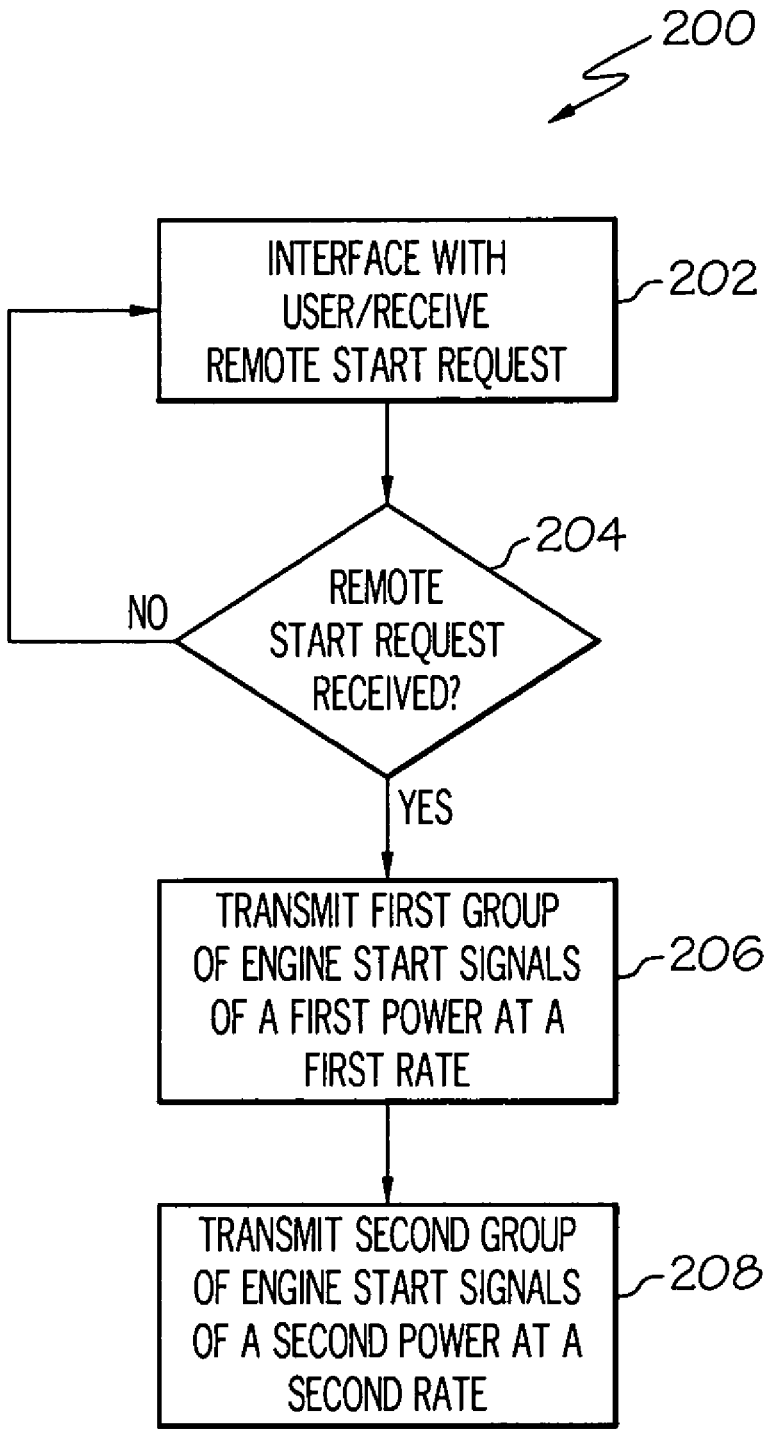
FIG. 2 is a flowchart of a process for remotely starting an engine of a vehicle that can be implemented in connection with the control system of FIG. 1, in accordance with an exemplary embodiment of the present invention.

FIG. 2 is a flowchart of a process 200 for remotely starting an engine of a vehicle, in accordance with an exemplary embodiment of the present invention. In a preferred embodiment, the process 200 can be implemented in connection with the control system 100 of FIG. 1 and/or through program products that can be utilized in connection therewith for remotely starting an engine of a vehicle, such as the engine 102 of the vehicle 103 of FIG. 1. However, it will be appreciated that in various embodiments the process 200 may also be utilized in connection with any number of different types of systems and/or other devices.

As depicted in FIG. 2, the process 200 includes the step of receiving a remote start request (step 202). In a preferred embodiment, the computer system 110 of FIG. 1 interfaces with a user of the vehicle 103 of FIG. 1 via the interface 126 of the computer system 110 to receive a remote start request from the user to start the engine 102 of the vehicle 103 of FIG. 1. In one embodiment, a remote start request is received before the user enters the vehicle. In another embodiment, such a remote start request is received from the user after the user enters the vehicle, for example if the battery 106 of the vehicle 103 of FIG. 1 has a low state of charge and the user is unable to start the engine 102 manually with an ignition key. In a preferred embodiment, the user provides the remote start request by pressing a button on a key fob of or otherwise manipulating the control system 100 of FIG. 1. In one preferred embodiment, by pressing a button of a key fob, the user causes a start request to be sent to the interface 126. The interface 126 then causes a signal indicative of the start request to be provided to the processor 120.

A determination is then made as to whether a remote start request has been received (step 204). In a preferred embodiment, this determination is made by the processor 120 of FIG. 1 as to whether the interface 126 of FIG. 1 has received a request from the user to remotely start the engine 102 of the vehicle 103.

If it is determined in step 204 that no remote start request has been received, then the process returns to step 202. Steps 202 and 204 then repeat until a determination is made in a subsequent iteration of step 204 that a remote start request has been received.

Once a determination is made in any iteration of step 204 that a remote start request has been received, the process continues with the transmission of a first group of engine start signals (step 206). Each of the first group of engine start signals has a first power level, and the remote start signals of the first group of engine start signals are transmitted at a first rate of approximately X milliseconds apart. For example, in one preferred embodiment, a relatively smaller number of first engine start signals (for example, less than five, in one exemplary embodiment, as compared with more than thirty of the second engine start signals described below in connection with step 208) are transmitted approximately one hundred milliseconds apart in step 206. In a preferred embodiment, the engine start signals of the first group of engine start signals are transmitted by the transmitter 112 of FIG. 1 based upon instructions provided thereto by the processor 120 of FIG. 1 and are received by the vehicle receiver 130 of FIG. 1.

After the transmission of the first group of engine start signals, the process continues with the transmission of a second group of engine start signals (step 208). Each of the second group of engine start signals has a second power level that is less than the first power level of the first group of engine start signals, and the remote start signals of the second group of engine start signals are transmitted at a second rate of approximately Y milliseconds apart, with Y being less than X, and the second rate thereby being faster than the first rate. In a preferred embodiment, Y is less than fifty percent of X.

For example, in one preferred embodiment, a relatively large number of second engine start signals (for example, greater than thirty, in one exemplary embodiment, as compared with less than five first engine start signals described above in connection with step 206) are transmitted approximately thirty milliseconds apart in step 208. In a preferred embodiment, the engine start signals of the second group of engine start signals are transmitted by the transmitter 112 of FIG. 1 based upon instructions provided thereto by the processor 120 of FIG. 1 and are received by the vehicle receiver 130 of FIG. 1.

Accordingly, the process 200 first provides for the transmission of a relatively smaller number of powerful and relatively spaced-apart first engine start signals to be sent to the vehicle. In many cases, the first engine start signals will start the engine of the vehicle. However, to help ensure that the engine of the vehicle is started even in cases in which the battery of the vehicle has a low state of charge, the process 200 also provides for the subsequent transmission of a relatively larger number of less powerful but more rapidly transmitted second engine start signals to be sent to the vehicle. As will be described in greater detail further below in connection with FIG. 3, the second engine start signals are spaced close enough apart so that the vehicle receives one of the second engine start signals shortly after the body control module (BCM) of the vehicle awakens after re-setting from a previous engine start attempt, so that the engine is still turning and a successful remote start of the engine is facilitated.

Figure 3:
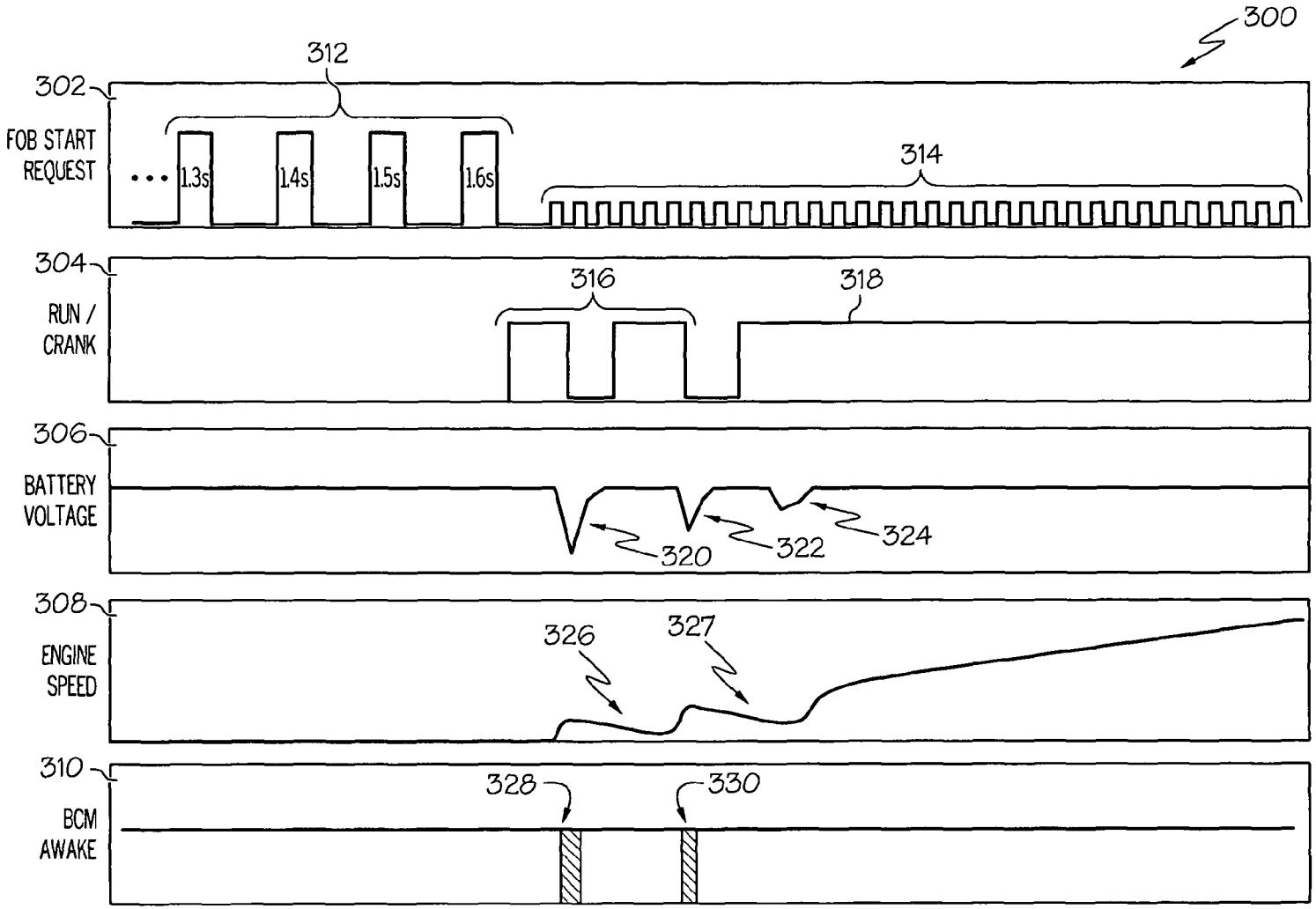
FIG. 3 is a sequence of graphical representations that further illustrates the process of FIG. 2 and the control system of FIG. 1, in accordance with an exemplary embodiment of the present invention.

Turning now to FIG. 3, a sequence 300 of graphical representations is provided that further illustrates the process 200 of FIG. 2 and the control system 100 of FIG. 1. A first graph 302 illustrates a first group of engine start signals 312 and a second group of engine start signals 314 corresponding to steps 206 and 208, respectively, of the process 200 of FIG. 2, in accordance with one exemplary embodiment of the present invention. As illustrated in the first graph 302, in this exemplary embodiment there are four relatively high-power engine start signals in the first group of engine start signals 312, and there are thirty two relatively low-power engine start signals in the second group of engine start signals 314. The number of first engine start signals 312 and second engine start signals 314 may vary in other embodiments or implementations, although preferably the number of second engine start signals 314 is significantly larger than the number of first engine start signals 312.

A second graph 304, a third graph 306, a fourth graph 308, and a fifth graph 310 illustrate various statuses of the engine, battery, and body control module of the vehicle during one exemplary implementation of the process 200 by the control system 100 of FIG. 1 in a vehicle have a battery with a low state of charge. Specifically, the second graph 304 represents a status as to when voltage is applied to enable engine operation, the third graph 306 represents a voltage of the battery, the fourth graph 308 represents a speed of the engine, and the fifth graph 310 represents a status of a body control module (BCM) of the vehicle during this exemplary implementation of the process 200.

In this exemplary implementation, the engine begins to crank and start briefly during two initial activation intervals 316 following the first group of engine start signals 312, as depicted in the second graph 304. These result in corresponding declines in battery voltage, as represented in regions 320 and 322 of the third graph 306. As a result of a sufficient decrease in battery voltage during the times represented in regions 320 and 322 of the third graph 306, the BCM resets, as represented by regions 328 and 330 of the fifth graph 310. This in turn causes the engine start to be aborted (as reflected in the termination of the engine start command after the initial intervals 316 of the second graph 304), which in turn causes the engine speed to decrease (as represented by regions 326 and 327 of the fourth graph 308).

Eventually, after enough of the second group of engine start signals 314 are transmitted, the voltage drops by a relatively lesser magnitude, as represented by region 324 of the third graph 306, and thus there is no reset of the BCM. The engine, which had begun to crank and start during the initial intervals 316 of the second graph 304, now continues to crank and fully starts as represented in a subsequent interval 318 of the second graph 304.

Specifically, in accordance with a preferred embodiment, the engine start signals of the second group of engine start signals 314 of the first graph 302 are spaced close enough apart so that the engine is still turning from the initial intervals 316 when the subsequent interval 318 begins, and thus the engine does not need to overcome the static coefficient of friction in the engine. As a result, the voltage drop represented in region 324 of the third graph 306 is minimized, the BCM does not reset again in the fifth graph 310, the engine continues to turn and is fully started in the subsequent interval 318 of the second graph 304, and the engine speed continues to increase as represented in the fourth graph 308. In addition, because each of the second group of engine start signals 314 has a reduced power compared with the engine start signals of the first group of engine start signals 312 of the first graph 302, this allows for easier compliance with Federal Communication Commission (FCC regulations) that limit the amount of power provided by such control devices. Moreover, this provides an alternative means for starting the engine in cases in which a traditional manual engine start with an ignition key may not effectuate an engine start due to a low battery charge and the accessory loads present during normal vehicle usage.

Accordingly, improved methods, program products, and systems are provided for remotely starting an engine of a vehicle. The improved methods, program products, and systems allow for improved starting of vehicle engines, particularly when a battery of the vehicle has a low state of charge. The improved methods, program products, and systems provide such improved remote starting of an engine of the vehicle while complying with FCC regulations. In addition, the improved methods, program products, and systems provide an alternative means for starting an engine of a vehicle in situations in which a traditional engine start with an ignition key would be more difficult due to a low state of charge of a battery of the vehicle.

It will be appreciated that, in various embodiments, the disclosed methods, program products, and systems may vary from those depicted in the figures and described herein. It will similarly be appreciated that, while the disclosed methods, program products, and systems are described above as being used in connection with automobiles such as sedans, trucks, vans, and sports utility vehicles, the disclosed methods, program products, and systems may also used in connection with any number of different types of vehicles, and in connection with any number of different systems thereof and environments pertaining thereto.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing the exemplary embodiment or exemplary embodiments. It should be understood that various changes can be made in the function and arrangement of elements without departing from the scope of the invention as set forth in the appended claims and the legal equivalents thereof.

What is claimed is:

1. A method for remotely starting an engine of a vehicle, the method comprising the steps of:

transmitting a first plurality of engine start signals to the vehicle, each of the first plurality of engine start signals having a first power level; and transmitting a second plurality of engine start signals to the vehicle, each of the second plurality of engine start signals having a second power level that is less than the first power level.

2. The method of claim 1, wherein:

the step of transmitting the first plurality of engine start signals comprises the step of transmitting the engine start signals of the first plurality of engine start signals approximately X milliseconds apart; and the step of transmitting the second plurality of engine start signals comprises the step of transmitting the engine start signals of the second plurality of engine start signals approximately Y milliseconds apart, with Y being less than X.

3. The method of claim 2, wherein:

the step of transmitting the second plurality of engine start signals comprises the step of transmitting the second plurality of engine start signals approximately Y milliseconds apart, with Y being less than fifty percent of X.

4. The method of claim 3, wherein the step of transmitting the first plurality of engine start signals comprises the step of transmitting the engine start signals of the first plurality of engine start signals approximately one hundred milliseconds apart.

5. The method of claim 4, wherein the step of transmitting the second plurality of engine start signals comprises the step of transmitting the engine start signals of the second plurality of engine start signals approximately thirty milliseconds apart.

6. The method of claim 1, wherein:

the step of transmitting the first plurality of engine start signals further comprises the step of transmitting a first number of the first plurality of engine start signals; and the step of transmitting the second plurality of engine start signals further comprises the step of transmitting a second number of the second plurality of engine start signals, the second number being greater than the first number.

7. The method of claim 1, further comprising the step of:

determining whether a remote start request has been received;

wherein:

the step of transmitting the first plurality of engine start signals comprises the step of transmitting the first plurality of engine start signals to the vehicle upon the further condition that the remote start request has been received; and the step of transmitting the second plurality of engine start signals comprises the step of transmitting the second plurality of engine start signals to the vehicle upon the further condition that the remote start request has been received.

8. A program product remotely starting an engine of a vehicle, the program product comprising:

(a) a program programmed to at least facilitate:

transmitting a first plurality of engine start signals to the vehicle, each of the first plurality of engine start signals having a first power level; and transmitting a second plurality of engine start signals to the vehicle, each of the second plurality of engine start signals having a second power level that is less than the first power level; and (b) a computer-readable signal bearing media bearing the program.

9. The program product of claim 8, wherein the program is further configured to at least facilitate:

transmitting the engine start signals of the first plurality of engine start signals approximately X milliseconds apart; and transmitting the engine start signals of the second plurality of engine start signals approximately Y milliseconds apart, Y being less than X.

10. The program product of claim 9, wherein Y is less than fifty percent of X.

11. The program product of claim 9, wherein the program is further configured to at least facilitate transmitting the engine start signals of the first plurality of engine start signals approximately one hundred milliseconds apart.

12. The program product of claim 10, wherein the program is further configured to at least facilitate transmitting the engine start signals of the second plurality of engine start signals approximately thirty milliseconds apart.

13. The program product of claim 8, wherein the program is further configured to at least facilitate:

transmitting a first number of the first plurality of engine start signals; and transmitting a second number of the second plurality of engine start signals, the second number being greater than the first number.

14. The program product of claim 8, wherein the program is further configured to at least facilitate:

determining whether a remote start request has been received;

transmitting the first plurality of engine start signals to the vehicle upon the further condition that the remote start request has been received; and transmitting the second plurality of engine start signals to the vehicle upon the further condition that the remote start request has been received.

15. A system remotely starting an engine of a vehicle, the system comprising:

a processor programmed to at least facilitate determining whether a remote start request has been received; and a transmitter coupled to the processor and configured to at least facilitate:

transmitting a first plurality of engine start signals to the vehicle if the remote start request is received, each of the first plurality of engine start signals having a first power level; and transmitting a second plurality of engine start signals to the vehicle if the remote start request is received, each of the second plurality of engine start signals having a second power level that is less than the first power level.

16. The system of claim 15, wherein the transmitter is further configured to at least facilitate transmitting the engine start signals of the first plurality of engine start signals are transmitted approximately X milliseconds apart; and transmitting the engine start signals of the second plurality of engine start signals are transmitted approximately Y milliseconds apart, Y being less than X.

17. The system of claim 15, wherein the transmitter is further configured to at least facilitate:

transmitting a first number of the first plurality of engine start signals; and transmitting a second number of the second plurality of engine start signals, the second number being greater than the first number.

18. The system of claim 15, further comprising:

an interface configured to at least facilitate receiving the remote start request and sending a signal representative thereof to the processor;

wherein the transmitter is further configured to at least facilitate:

transmitting the first plurality of engine start signals to the vehicle upon the further condition that the remote start request has been received; and transmitting the second plurality of engine start signals to the vehicle upon the further condition that the remote start request has been received.

19. The system of claim 15, wherein the transmitter is further configured to at least facilitate transmitting the engine start signals of the first plurality of engine start signals approximately one hundred milliseconds apart.

20. The system of claim 19, wherein the transmitter is further configured to at least facilitate transmitting the engine start signals of the second plurality of engine start signals approximately thirty milliseconds apart.

* * * * *